US007231742B2

(12) United States Patent
Majlessi

(10) Patent No.: US 7,231,742 B2
(45) Date of Patent: Jun. 19, 2007

(54) STRUCTURAL BRACED FRAME WALL PANEL SYSTEM

(76) Inventor: Kamran Reza Majlessi, 6085 Baine Ave., Newark, CA (US) 94560

( * ) Notice: Subject to any disclaimer, the term of this patent is extended or adjusted under 35 U.S.C. 154(b) by 327 days.

(21) Appl. No.: 10/828,102

(22) Filed: Apr. 19, 2004

(65) Prior Publication Data

US 2005/0229509 A1 Oct. 20, 2005

(51) Int. Cl.
*E04C 3/02* (2006.01)
*E04H 9/02* (2006.01)

(52) U.S. Cl. ..... 52/167.3; 52/745.19; 52/693; 52/695

(58) Field of Classification Search ..... 52/745.19, 52/693, 696, 238, 481.1, 376, 695, 295, 638, 52/657, 238.1, 167.3; 29/897.32
See application file for complete search history.

(56) References Cited

U.S. PATENT DOCUMENTS 5,301,486 A * 4/1994 Taylor ..... 52/695
6,014,843 A * 1/2000 Crumley et al. ..... 52/167.3
6,158,184 A 12/2000 Timmerman, Sr. et al.
6,244,004 B1 6/2001 Timmerman, Sr. et al.
6,298,617 B1 10/2001 De Quesada
6,389,778 B1 * 5/2002 Strange ..... 52/745.19
6,460,297 B1 * 10/2002 Bonds et al. ..... 52/79.1
6,505,442 B2 * 1/2003 Banicevic et al. ..... 49/501
6,513,290 B2 2/2003 Leek
6,715,258 B1 * 4/2004 Mueller ..... 52/745.12
6,941,718 B1 * 9/2005 diGirolamo et al. ..... 52/695
2002/0108325 A1 8/2002 Hulls et al.

OTHER PUBLICATIONS

"*The Hardy Frame Shearwall System*", Hardy Frames, Inc., A MiTek Company, pp. 1-4, undated.
"*The Smart Shear Wall Solution*", Installation Manual, Hardy Frames, Inc., pp. 1-20, undated.
"*Legacy Report*", ICC-ES Evaluation Service, Inc., pp. 1-40, Jun. 1, 2003.
"*Announcement*", Hardy Frames, Inc., A MiTek Company, pp. 1-3, May 19, 2003.
"*There Is No Comparison!*", Hardy Frames, Inc., p. 1, undated.

* cited by examiner

*Primary Examiner*—Tamara L. Graysay
(74) *Attorney, Agent, or Firm*—Buchanan Ingersoll & Rooney LLP

(57) ABSTRACT

A metal panelized wall system having a plurality of generally parallel vertical wall studs with an opening formed in each one. A top horizontal member is connected to a top end of each of the vertical wall studs and a bottom horizontal member is connected to a bottom end of each of the vertical wall studs. Extending from the bottom horizontal member to the top horizontal member is at least one diagonal member. The diagonal member extends through the openings formed in the vertical wall studs such that loads from the vertical wall studs are not transferred to the diagonal member.

17 Claims, 4 Drawing Sheets

STRUCTURAL BRACED FRAME WALL PANEL SYSTEM

FIELD OF THE INVENTION

The present invention relates generally to construction techniques using metal wall studs and more particularly to providing diagonal "X" bracing to the wall.

BACKGROUND OF THE INVENTION

Metal wall studs are used in the construction industry to provide the framing members used for the construction of buildings. The metal wall studs are used instead of conventional wood framing members to form the wall panels. The panels can be pre-assembled and delivered to the building site where they are put in place.

The typical wall panel consists of horizontal and vertical studs. In order to provide further reinforcement, diagonal wall members are placed between the corners of the panels. The diagonal members are needed to resist lateral loads to the wall panel and to comply with seismic building requirements. The diagonal members are straps that are typically connected to the face of the studs. In this arrangement, the diagonal members can only provide resistance to tension forces in one direction. Due to building requirements, this type of arrangement cannot be used for two story structures. Also, the strap usually adds thickness to the wall panel which complicates the finishing of the structure.

In addition to using straps, threaded rods can also be used as the diagonal members. However, the threaded rods suffer the same drawbacks as the strap. Specifically, the threaded rod can only take tension loads and will buckle under compressive loads. The threaded rod is therefore not adequate to meet seismic building codes. Furthermore, the threaded rods add thickness to the building panel thereby complicating construction.

SUMMARY OF THE INVENTION

In accordance with the present invention there is provided a panelized wall system with diagonal members that can meet seismic building standards for the construction of multistory buildings. The panelized wall system comprises vertical and horizontal studs with diagonal members to provide additional strength against compressive and tension forces. In order to meet seismic requirements, each of the vertical studs includes a reinforced opening through which a diagonal member extends through. In this respect, the gravity loads of the structure are not transferred to the diagonal members by the vertical studs because the vertical studs are not connected to the diagonal members. It is therefore possible to build multistory structures with a panelized wall system and still provide the necessary strength required by seismic building codes.

A panelized wall system of the present invention consists of a plurality of generally parallel vertical wall studs with an opening formed in each one. The system further includes a top horizontal member connected to a top end of each of the vertical wall studs. Furthermore, a bottom horizontal member is connected to a bottom end of each of the vertical wall studs. Extending from the bottom horizontal member to the top horizontal member is at least one diagonal member. The diagonal member extends through the openings formed in the vertical wall studs such that loads from the vertical wall studs are not transferred to the diagonal member.

Preferably, the vertical wall studs, the top horizontal member, the bottom horizontal member and the diagonal member are fabricated from steel. A first gusset plate is used to attach the diagonal member to the top horizontal member and a second gusset plate is used to attach the diagonal member to the bottom horizontal member.

A stiffener may be attached to each vertical wall stud around the opening. Typically, the width of the opening is 70% the width of the vertical wall stud. The openings are formed in the vertical wall studs at the locations where the diagonal member intersects the vertical wall stud.

In a preferred embodiment, the panelized wall system has two diagonal members. Each of the diagonal members extends from opposite ends of the top horizontal member and the bottom horizontal member. At the location where the diagonal members intersect, one of the diagonal members is cut and a bracket is used to cross the other diagonal member.

BRIEF DESCRIPTION OF THE DRAWINGS

These, as well as other features of the present invention, will become more apparent upon reference to the drawings wherein.

DETAILED DESCRIPTION

Figure 1:
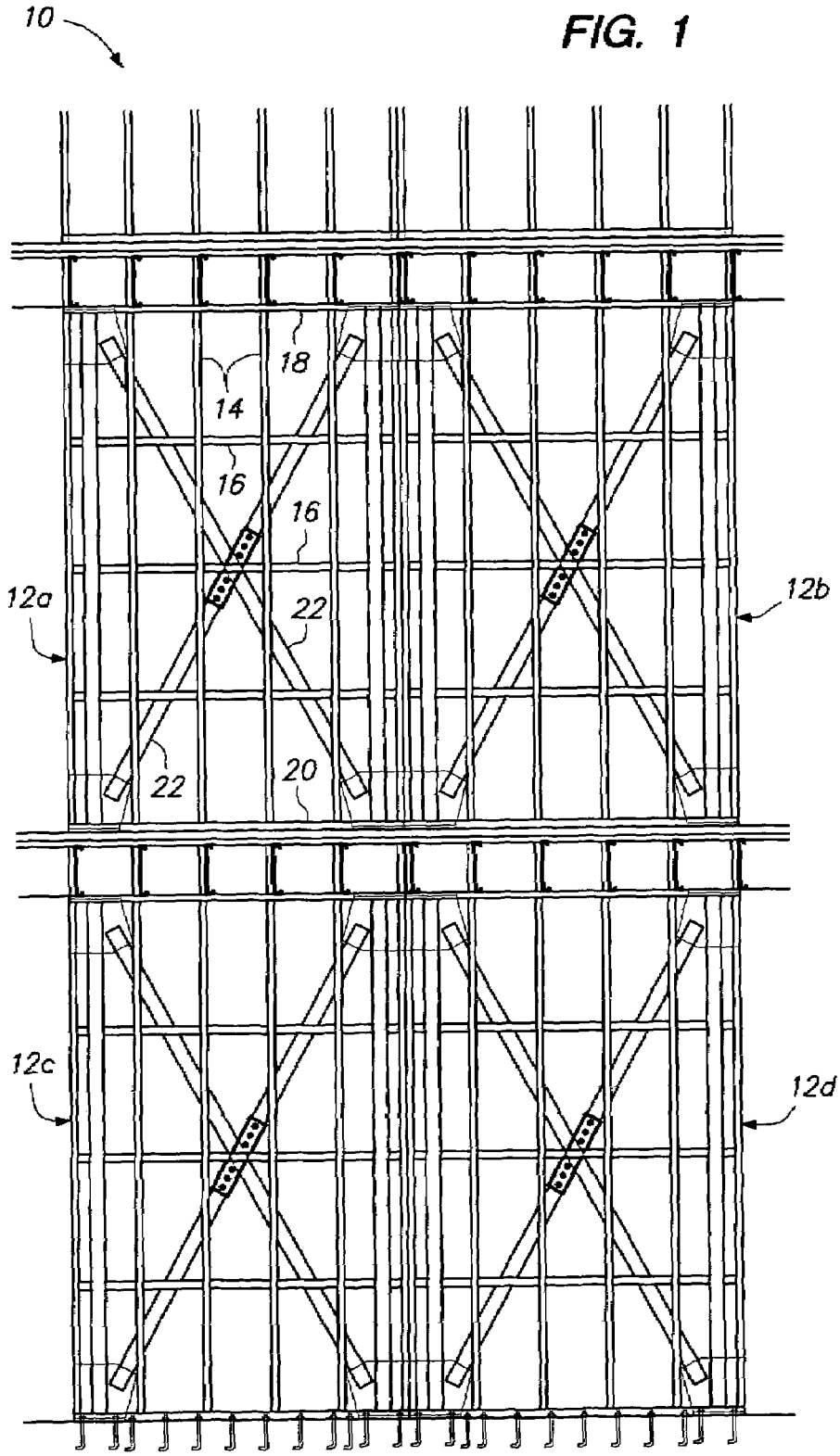
FIG. 1 is an elevation view of a structure having the panelized wall system of the present invention using diagonal members.

Referring now to the drawings wherein the showings are for purposes of illustrating preferred embodiments of the present invention only, and not for purposes of limiting the same, FIG. 1 is an elevation view of a wall 10 used in the construction of a building structure. The wall 10 is made from four panels 12*a*–12*d*. Each of the panels 12 is primarily fabricated from metal wall studs of light gage steel as is commonly known. The panels 12 can be constructed off-site and delivered to the building construction site for assembly. Referring to panel 12*a*, each of the panels 12 has vertical wall studs 14 and horizontal wall studs 16. The vertical wall studs 14 run continuously between a top plate 18 and a bottom plate 20 and are horizontally spaced about sixteen inches apart. The horizontal wall studs 16 are blocking members that are connected between adjacent vertical studs 14. The horizontal studs 16 are fabricated from the same light gage steel as the vertical studs 14 and are connected thereto with clips, straps, brackets, screws, etc. . . . The horizontal studs 16 are spaced vertically to have a maximum vertical spacing of about thirty-six inches. The panels 12 also include horizontal straps running continuously across the panels 12 to prevent rotation and buckling of the panel. For sake of simplicity, the straps have been removed from the drawings. The straps are collinear with the horizontal wall studs 16.

In accordance with the present invention, each of the panels 12 includes at least one diagonal member 22. Preferably, each of the diagonal members 22 are connected to the corners of each panel to form an "X" and provide the necessary strength to resist seismic forces. The diagonal members 22 are formed from steel also and can have a cross-section configuration such as a channel, tube or any other suitable shape. Preferably, the cross-section of the diagonal members is tubular.

Figure 4:
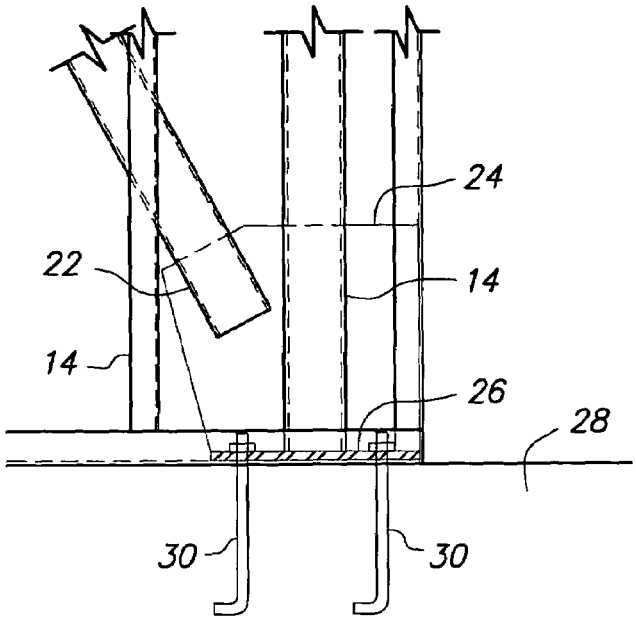
FIG. 4 is an elevation view of a base to foundation connection for the panelized wall system.
Figure 5:
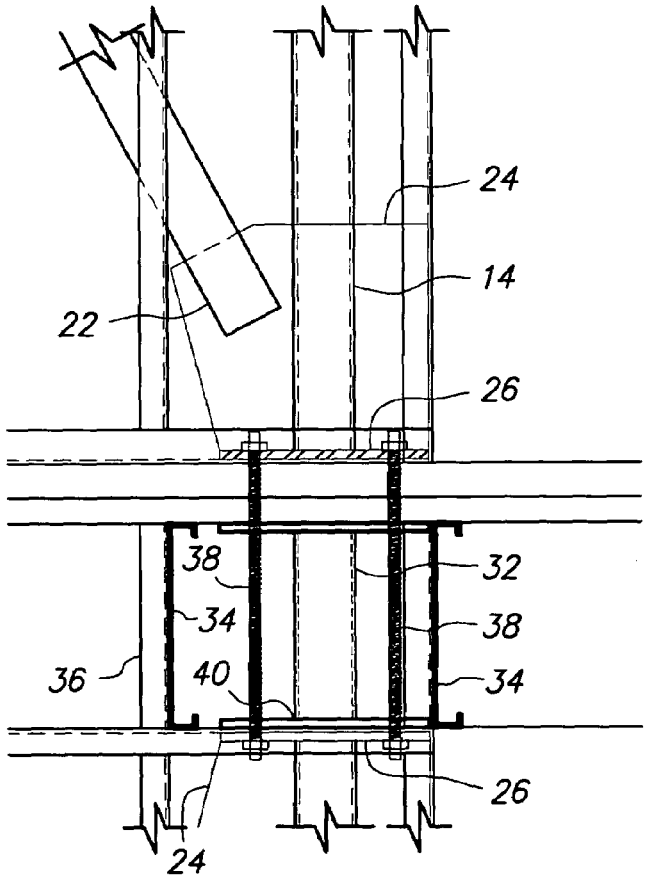
FIG. 5 is an elevation view of a floor to floor connection of the panelized wall system.

Referring to FIGS. 4 and 5, the diagonal members 22 are connected to the corners of each panel 12 with a gusset plate 24. FIG. 4 illustrates the connection of the panel 12 to a foundation, while FIG. 5 illustrates a floor to floor connection of a panel 12. The gusset plate 24 is made from structural steel and is preferably welded to the diagonal member 22. Of course, it will be recognized by those of ordinary skill in the art that there are other types of methods for attaching the gusset plate 24 to the diagonal member 22 such using screws, bolts, etc . . . .

Referring to FIG. 4, the gusset plate 24 is connected to a base plate 26 in order to securely fasten the diagonal member 22 to the corner of the panel 12. The base plate 26 is connected to the bottom plate 20 and a foundation 28 through the use of base plate anchor bolts 30 which are embedded into the foundation 28. Referring to FIG. 5, the connection of the diagonal member 22 to the panel 12 for a floor to floor connection is shown and is similar to the floor to foundation connection. In this respect, the diagonal member 22 is connected to the gusset plate 24 which in turn is connected to the base plate 26. The base plate 26 is connected to a base plate 26 and gusset 24 of an adjoining floor through the use of threaded rods 38. A compression element 32 and web stiffener 36 are placed between the adjoining panels. In this regard, the floor joists 34 separate the panels.

Figure 3:
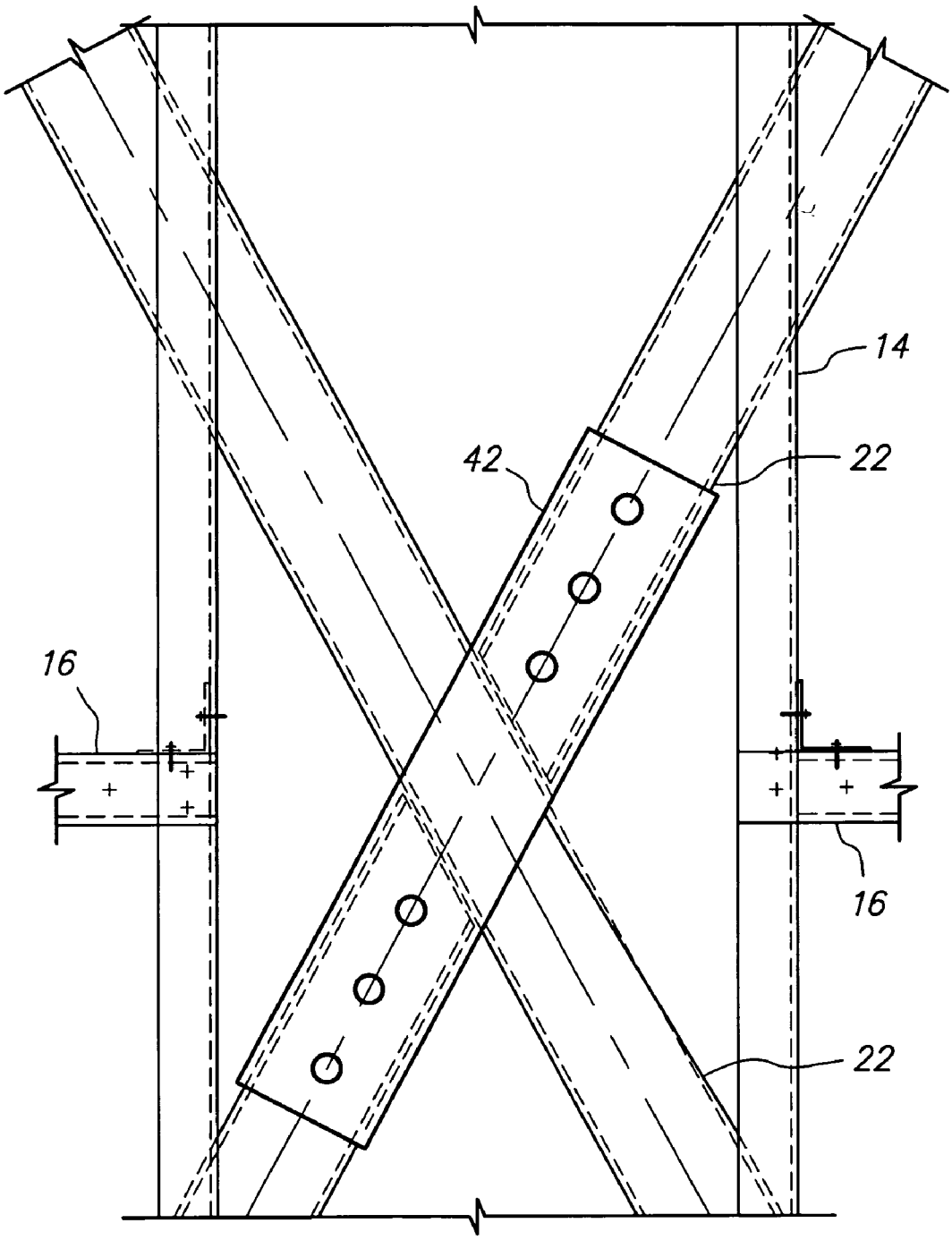
FIG. 3 is an elevation view of bracing used with the diagonal members of the panelized wall system of FIG. 1.

As can be seen in FIG. 1, the diagonal members 22 cross each other at the center of the "X". Therefore, the diagonal members 22 are braced at this intersection in order to transfer loads. Specifically, referring to FIG. 3, a bracket 42 is attached to both sides of the diagonal member 22 that is not continuous across the intersection. As will be recognized, in order to form the intersection, one of the diagonal members 22 must be cut and is discontinuous. The bracket 42 connects both ends of the discontinuous diagonal member 22 and is fastened to the diagonal member 22 through a suitable connection method such as using plug welding or fasteners. Preferably, a bracket 42 is attached to both sides of the diagonal member 22.

Figure 2:
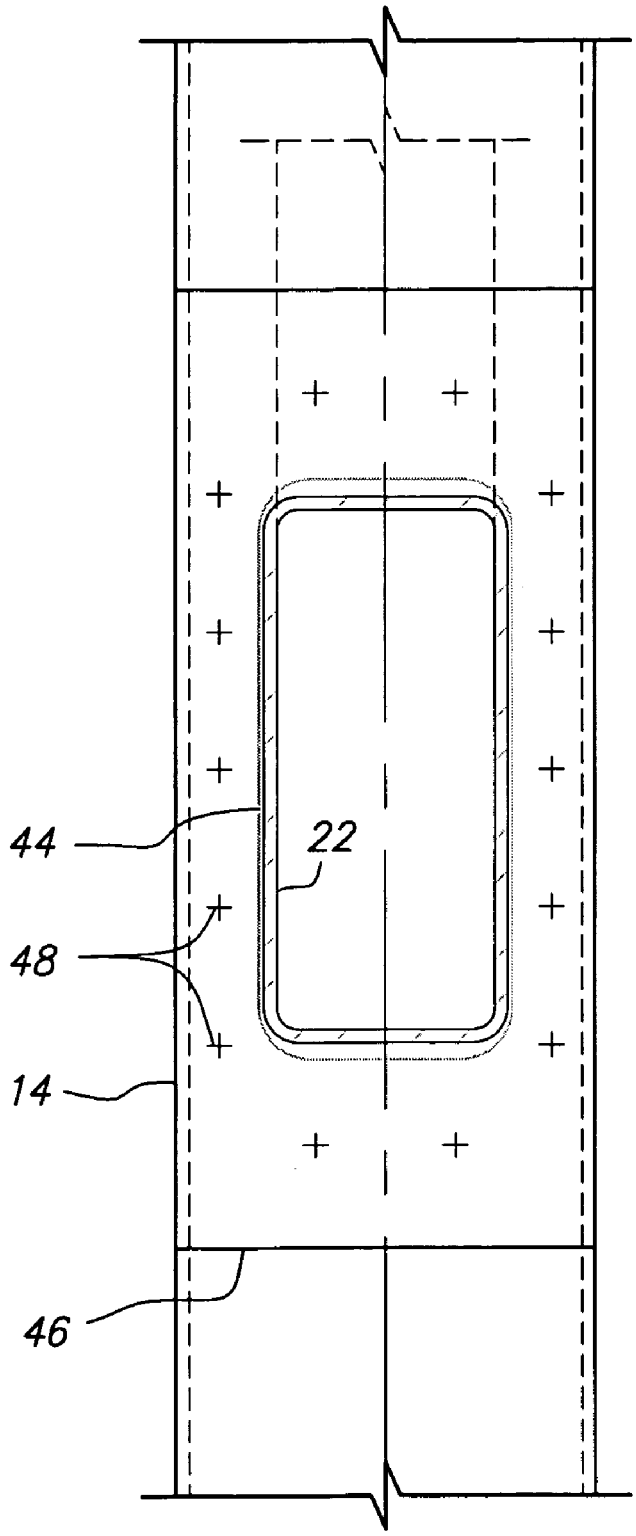
FIG. 2 is an elevation view of a vertical stud used with the panelized wall system of FIG. 1.

In order to prevent gravity loads from the vertical wall studs 14 being transferred to the diagonal members 22, each vertical stud 14 has an opening formed therein for the diagonal member 22 to extend therethrough. Referring to FIG. 2, an opening 44 in a vertical stud 14 is shown. The opening 44 is formed slightly larger than the diagonal member 22. Typically, the opening is 70% of the width of the vertical stud 14 in order to maintain the structural integrity of the vertical stud 14. Furthermore, in order to further strengthen the vertical stud 14 in the area of the opening, a stiffener 46 is attached to the vertical stud 14. The stiffener 46 is a plate of steel and is attached to the vertical stud with screws 48. The opening 44 allows the diagonal member 22 to pass through the vertical stud 14 without transferring load. This allows the diagonal members 22 to carry lateral loads without the gravity loads from the vertical wall studs 14. Furthermore, because the diagonal member 22 is positioned within the vertical studs 14, finishing the building with the panel is simplified because the exterior of the vertical wall studs 14 are smooth and flush.

Additional modifications and improvements of the present invention may also be apparent to those of ordinary skill in the art such as scaling up or down the size of the panels depending upon the application. Thus, the particular combination of parts described and illustrated herein is intended to represent only certain embodiments of the present invention, and is not intended to serve as limitations of alternative devices within the spirit and scope of the invention.

What is claimed is:

1. A panelized wall system that resists seismic forces, the system comprising:

a plurality of generally parallel vertical wall studs, each of the vertical wall studs having an opening formed therein;

a top horizontal member connected to a top end of each of the vertical wall studs;

a bottom horizontal member connected to a bottom end of each of the vertical wall studs;

at least one diagonal member extending from the bottom horizontal member to the top horizontal member, the diagonal member extending through the openings formed in the vertical wall studs such that loads from the vertical wall studs are not transferred to the diagonal member; and a stiffener attached to each vertical wall stud around the opening.

2. The system of claim 1 wherein the vertical wall studs, the top horizontal member, the bottom horizontal member and the diagonal member are fabricated from steel.

3. The system of claim 1 further comprising a gusset plate attached to the top horizontal member and a top end of the diagonal member.

4. The system of claim 1 further comprising a gusset plate attached to the bottom horizontal member and a bottom end of the diagonal member.

5. The system of claim 1 further comprising horizontal wall studs attached to the vertical wall studs.

6. The system of claim 5 wherein the openings are formed in the vertical wall studs at the locations where the at least one diagonal members pass through the openings in the vertical wall studs.

7. A panelized wall system that resists seismic forces, the system comprising:

a plurality of generally parallel vertical wall studs, each of the vertical wall studs having an opening formed therein;

a top horizontal member connected to a top end of each of the vertical wall studs;

a bottom horizontal member connected to a bottom end of each of the vertical wall studs;

at least two diagonal members extending from the bottom horizontal member to the top horizontal member, the diagonal members extending through the openings formed in the vertical wall studs such that loads from the vertical wall studs are not transferred to the diagonal members, wherein the at least two diagonal members comprise a first diagonal member and a second diagonal member, the second diagonal member being discontinuous at an intersection.

8. The system of claim 7 further comprising at least one bracket attached to the second diagonal member at the intersection of the first diagonal member, the bracket being configured to attach the ends of the second diagonal member across the first diagonal member.

9. The system of claim 7 wherein the vertical wall studs, the top horizontal member, the bottom horizontal member and the at least two diagonal members are fabricated from steel.

10. A method of building a panelized wall system that resists seismic forces, the method comprising the following steps:

providing a plurality of vertical wall studs, each of the vertical wall studs having an opening formed therein;

attaching a stiffener to each vertical wall stud around the opening;

attaching a top end of the vertical wall studs to a top horizontal member;

attaching a bottom end of the vertical wall studs to a bottom horizontal member such that the vertical wall studs are generally parallel; and extending at least one diagonal member from the bottom horizontal member to the top horizontal member through the openings formed in the vertical wall studs such that loads from the vertical wall studs are not transferred to the diagonal member.

11. The method of claim 10 wherein the vertical wall studs, the top horizontal member, the bottom horizontal member and the diagonal member are fabricated from steel.

12. The method of claim 10 further comprising the step of attaching a gusset plate to the top horizontal member and the diagonal member.

13. The method of claim 10 further comprising the step of attaching a gusset plate to the bottom horizontal member and the diagonal member.

14. The method of claim 10 further comprising the step of attaching horizontal wall studs between the vertical wall studs.

15. The method of claim 10 wherein the providing step further comprises the step of forming the opening in the vertical wall studs at the locations where the diagonal members intersect the vertical wall studs.

16. A method of building a panelized wall system that resists seismic forces, the method comprising the following steps:

providing a plurality of vertical wall studs, each of the vertical wall studs having an opening formed therein;

attaching a top end of the vertical wall studs to a top horizontal member;

attaching a bottom end of the vertical wall studs to a bottom horizontal member such that the vertical wall studs are generally parallel;

extending at least two diagonal members from the bottom horizontal member to the top horizontal members through the openings formed in the vertical wall studs such that loads from the vertical wall studs are not transferred to the diagonal member; and wherein the at least two diagonal members comprise a first diagonal member and a second discontinuous diagonal member and the step of extending the at least two diagonal members further comprises attaching discontinuous ends of a second diagonal member across the first diagonal member with a bracket.

17. The method of claim 16 wherein the vertical wall studs, the top horizontal member, the bottom horizontal member and the at least two diagonal members are fabricated from steel.

* * * * *